US005882271A

United States Patent [19]

Byrd

[11] Patent Number: 5,882,271

[45] Date of Patent: Mar. 16, 1999

[54] BASKETBALL COURT

[76] Inventor: Douglas Byrd, 980 Lazybrook, Grand Prairie, Tex. 75050

[21] Appl. No.: 939,607

[22] Filed: Sep. 29, 1997

[51] Int. Cl.[6] ..... A63B 67/00

[52] U.S. Cl. ..... 473/472

[58] Field of Search ..... 473/472; 434/248

[56] References Cited

U.S. PATENT DOCUMENTS 4,171,808 10/1979 Bauer ..... 473/472

*Primary Examiner*—William H. Grieb

*Attorney, Agent, or Firm*—Morgan L. Crow, P.E.

[57] ABSTRACT

A basketball court is disclosed, having a circle on the floor under each goal hoop to clearly designate the area under the hoop. This is a critical matter in the playing and refereeing of the game, in the determination by players and referees whether or not the defensive player is directly under the hoop, and therefore may be subject to being call for a foul in the case of contact between offensive and defensive players.

8 Claims, 1 Drawing Sheet

BASKETBALL COURT

BACKGROUND OF THE INVENTION

The Field of the Invention

This invention relates to the game of basketball played in an organized manner utilizing one or more officials to referee the game. The National Basketball Association (NBA) Rule E relating to Charging-Blocking, paragraph 3 states: "If a defensive player acquires a position directly under the basket/backboard on anything but a 'baseline drive,' he shall be responsible if contact occurs." A referee therefore needs to be able to determine accurately whether or not a defensive player is directly under the basket.

The current rule as to Charging-Blocking requires too much of a referee to make a judgement to determine the location of the players when a play is made. A referee must now look up to the goal hoop and project the diameter of the goal hoop down to the floor to determine whether or not a player is under the goal hoop. A referee caught out of position when a play is made must make a call without proper visual position of the player with respect to the goal hoop.

It is an object of this invention to assist a basketball referee make correct calls by providing reference marking on the floor.

It is an object of this invention to enable a referee to make a call without talking his eyes off the players to look at the goal hoop for position.

It is an object of this invention to make the referee calls more accurate by providing reference marking on the floor.

It is an object of this invention to speed up the game by reducing questions by coaches as to actual location of players involved in Charging-Blocking fouls.

SUMMARY OF THE INVENTION

A basketball court marked according to National Basketball Association (NBA) or National Collegiate Athletic Association (NCAA) rules with the addition of eighteen inch diameter circular markings directly below the goal basket hoops at each end of the court.

DESCRIPTION OF THE PREFERRED EMBODIMENT

Figure 1:
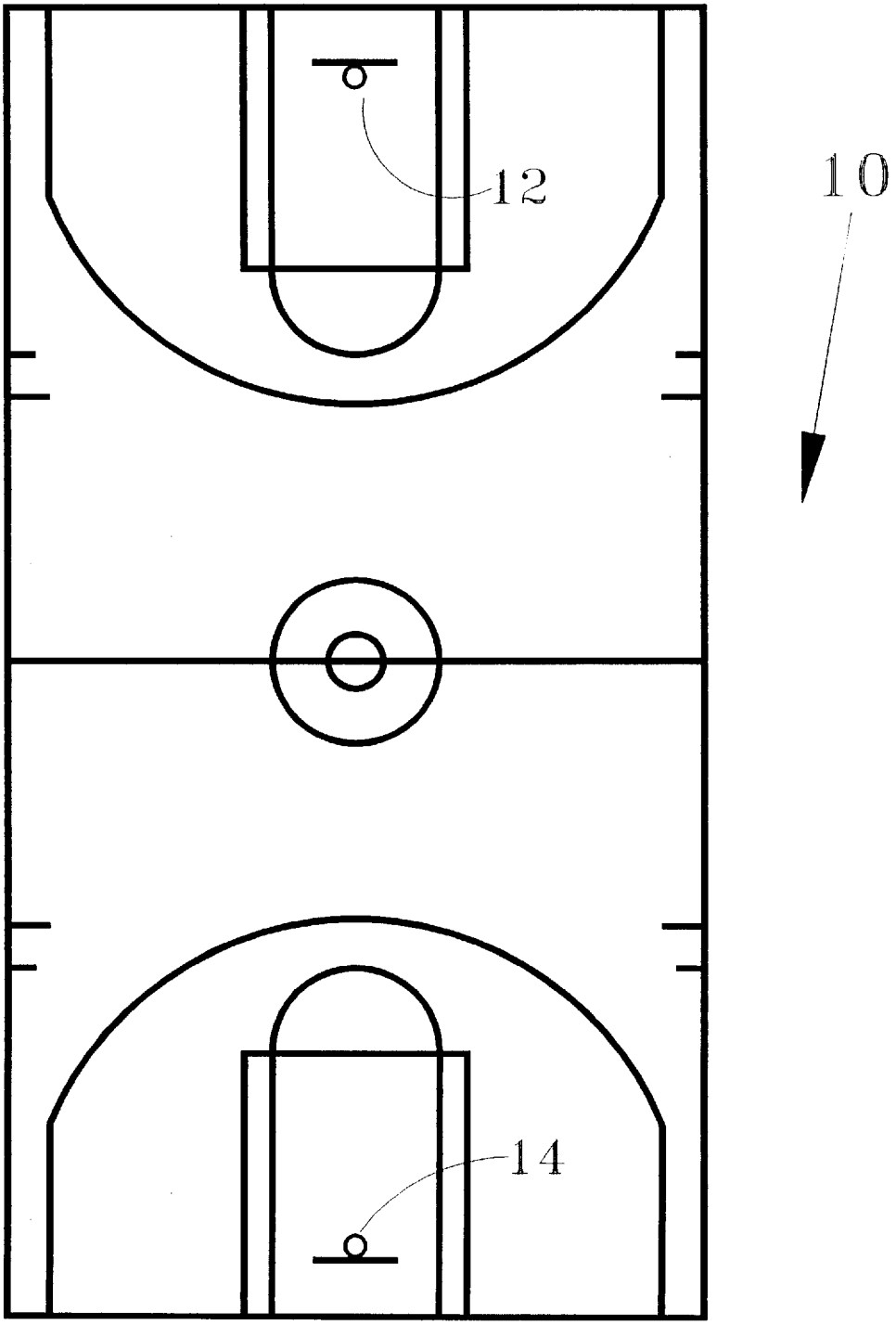
FIG. 1 is a basketball court layout according the present invention.

Referring to FIG. 1, a standard basketball court layout is illustrated at 10. Circles 12 and 14 are marked on the floor directly below the goal hoops at each end of the court. The standard hoops are 18 inches outside diameter. Circles 12 and 14 are 18 inches outside diameter. Circles 12 and 14 may be of a solid contrasting color to the surrounding floor. Circles 12 and 14 may also be marked with 2 inch wide lines and 18 inches to the outside diameter of the circles.

In the game of basketball, there is a rule regarding charging and blocking. The rule states: "If a defensive player acquires a position directly under the basket/backboard on anything but a 'baseline drive' he shall be responsible if contact occurs." Therefore the referee officiating the game needs to be able to determine whether a player is DIRECTLY under the basket. The determination of the defensive player's position is critical, in that contact between offensive and defensive players can be called as a foul. If the defensive player is DIRECTLY under the basket, it is a foul against the defensive player. If the defensive player is NOT DIRECTLY under the basket, it is a foul against the OFFENSIVE player. Since the official must now visualize an extension of the basket to the floor, then decide whether or not the defensive player was directly under the basket. Since this is a judgement call without any guiding mark, many disputes arise questioning the position of the defensive player.

Description of an Alternate Embodiment

The preferred embodiment shown and described comprises 18 inches diameter circles marked on the basketball court floor directly under the basket. It is understood that the marking line could be of a width other than 2 inches. It is also possible within this invention to have a circle marked with a solid circle of the same diameter as the basket.

Use of the Preferred Embodiment

The described circles under the goal hoops provide the offensive and defensive players with a reference to ascertain whether or not a defensive player is in position to be called for a Charging-Blocking foul. This can assist the defensive player to find an advantageous position for defense without making himself vulnerable to a charging-blocking foul. This can assist the offensive player to determine whether of not a defensive player is in position to be vulnerable to a charging-blocking foul.

The described circles under the goal hoops provide the game officials with a reference to ascertain whether or not the defensive player is in position to be called for a Charging-Blocking foul. With the present invention, a game official can determine whether or not a defensive player is DIRECTLY under the basket in case of contact between offensive and defensive players, and therefore, the decision to call a foul on the offense or defense is made much easier. The present invention reduces the requirement of spatial visualization on the part of the game official.

For purposes of this specification and claims, the terms hoop, goal hoop and basket have interchangeable meaning. For purposes of this specification and claims, the term paint means an area of solid color including a painted area, an area covered with tape of a different color from the surrounding area, different color wood or tile inlaid in the floor and any other means of applying a different color from the surrounding area to an area of the floor. It is understood that a woven string tapered tubular net may be suspended from a hoop and be included in the interchangeable meaning of basket and hoop in this specification.

It will be understood that the invention is not limited to the embodiments disclosed, but is capable of rearrangements, modifications, and substitutions and reversals of parts and elements without departing from the spirit of the invention.

I claim:

1. An improved basketball court for playing a game of basketball, including a floor and at least one goal basket hoop, said hoop having an outside diameter, and wherein the improvement comprises:

at least one paint circle marked on the floor of the court, the outside diameter of said circle being substantially equal to the outside diameter of the goal basket hoop, said circle positioned directly beneath each goal basket hoop on the court, whereby a referee may, by reference to the circle, determine whether a player is positioned beneath a goal basket hoop in violation of the rules of the game.

2. A basketball court according to claim 1 further comprising:

said circle having an outside diameter of eighteen inches.

3. A basketball court according to claim 2 further comprising:

said circle being defined by a line two inches wide.

4. A basketball court according to claim 1 further comprising:

said circle being defined by a line two inches wide.

5. An improved basketball court for playing a game of basketball, including a floor and at least one goal basket hoop, said hoop having an outside diameter, and wherein the improvement comprises:

at least one paint mark on the floor of the court, having an inside diameter, said diameter being substantially equal to the outside diameter of the goal basket hoop, said mark positioned directly beneath said goal basket hoop on the court, whereby a referee may, by reference to the diameter, determine whether a player is positioned beneath said goal basket hoop in violation of the rules of the game.

6. A basketball court according to claim 5 further comprising:

each said mark having an inside diameter of eighteen inches.

7. A basketball court according to claim 6 further comprising:

said mark being defined by a line two inches wide.

8. A basketball court according to claim 5 further comprising:

said mark being defined by a line two inches wide.

* * * * *